United States Patent [19]

Levy

[11] 4,188,741

[45] Feb. 19, 1980

[54] KEY

[76] Inventor: Lawrence L. Levy, 980 Iris La., Baldwin, N.Y. 11510

[21] Appl. No.: 896,555

[22] Filed: Apr. 14, 1978

[51] Int. Cl.[2] ..... G09F 3/00

[52] U.S. Cl. ..... 40/330; 40/2 A

[58] Field of Search ..... 40/330, 2 A, 19, 10 R

[56] References Cited

U.S. PATENT DOCUMENTS

| | | | |
|---|---|---|---|
| 312,545 | 2/1885 | Zeilin | 40/330 |
| 1,485,075 | 2/1924 | Gumaer | 40/330 |
| 2,065,468 | 12/1936 | Keil | 40/330 |
| 2,533,006 | 12/1950 | Goldsmith | 40/330 |
| 2,781,594 | 2/1957 | Stupell | 40/330 |
| 3,324,586 | 6/1967 | Mitchell | 40/330 |
| 4,073,612 | 2/1978 | Nitta | 40/10 R X |

*Primary Examiner*—John F. Pitrelli

*Attorney, Agent, or Firm*—Paul J. Sutton

[57] ABSTRACT

The present invention provides a key capable of being rapidly and efficiently identified by the user, whether in a lighted or dark environment. In a number of preferred embodiments of this invention, the key carries a panel or strip on which the user, at his or her option, may apply indicia in the form of a name, identification of the cooperative cylinder lock with which the key is associated, or, by way of example only, a decorative symbol which may catch the user's fancy or political persuasion. Magnifying, duplicate viewing and phosphorescent-type members are contemplated as coming within the scope of this invention, as are small tactile projections which are capable of being used and/or changed by the user to identify the key without actually viewing it.

6 Claims, 6 Drawing Figures

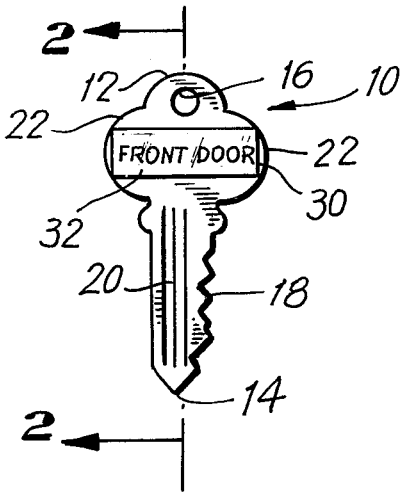
FIG. 1
FIG. 3
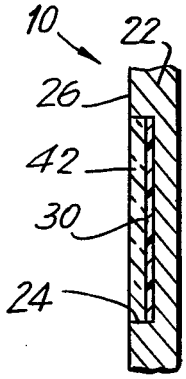
FIG. 4
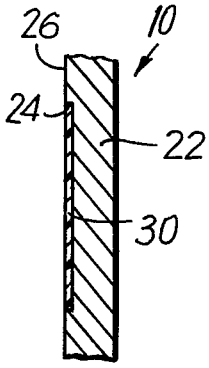
FIG. 2
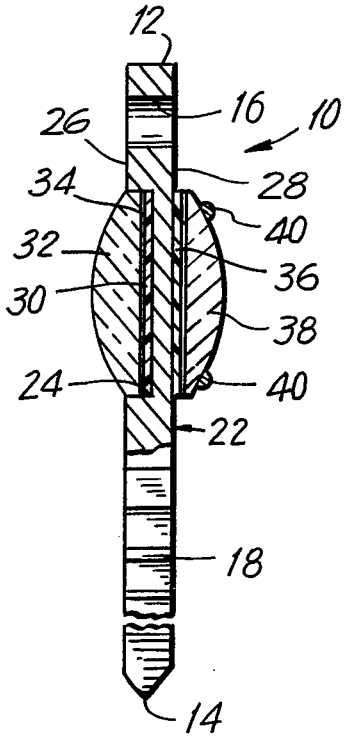
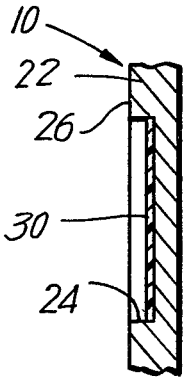
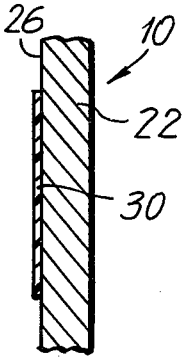
FIG. 5 FIG. 6

KEY

The present invention relates generally to the key art, and more particularly to an improved, low cost key capable of being rapidly and efficiently identified by the user.

The proliferation of gadgets, accessories and novelties that permeates our marketplace is a reflection of the buying propensities of the average consumer. Relatively low-cost novelties that catch the fancy of the prospective purchaser are only in a relatively few cases actually useful to the user once they are purchased. Thus, once they are purchased, these novelties are usually put aside after the brief impulse gratification is satisfied with the purchase, and more often than not, these items are simply either accumulated or discarded without adding real or substantive value to the life of the user or purchaser.

It is an object of the present invention to provide a relatively low-cost item that not only has novelty appeal, but is calculated to add convenience to the life of the user in a number of different ways. By this I mean that I recognize the fact that while the present invention is certainly not an indispensable necessity as might be compared to a heart pacemaker implant, as an example, I nonetheless believe that a great many people will significantly benefit from this invention if it is marketed in an embodiment that will be more fully and completely described in detail below with reference to the drawings.

The present contemplates providing a key that may be rapidly and efficiently identified by the user, whether visually or by touch alone.

Another object of the present invention is to provide a key carrying a strip on which indicia significant to the user may be affixed to the strip by the user, thereby providing reference information that can be obtained by the key at a glance.

A further object of the present invention is to provide an identifiable key, as described above, but further including a magnifying member which enlarges the image of the indicia placed on the strip by the user so as to provide relatively easy access to this information.

Yet another object of the present invention is to provide one or a plurality of relatively small projections on the key described above, thereby providing the user with a tactile means of contacting the key either in the pocket of the user or within an environment in which there is little or no light, thereby providing reference information that is coordinated with the number of projections on the key itself.

Yet a further object of this invention is to provide a relatively low-cost key incorporating the above-referenced features.

Another object of the present invention is to provide a key, as set forth above, wherein the strip bearing the indicia placed thereon by the user may be situated on the key in any number of different structural configurations, such as beneath the surface thereof, above the surface thereof, etc.

Still another object of this invention is to provide a key as defined above, wherein a plurality of strips bearing indicia are provided for the use of the user, and in which magnifying members or means associated with each of said strips is optionally coordinated with the projection means providing the user with a touch-type method of identifying the key with its associated use, owner, or cylinder lock with which it is associated.

One need not be a genius to understand and recognize that many attempts to improve the key-associated art have been published and, in some cases, marketed. People and inventors are drawn to this art for a variety of reasons, among them being the number of uses keys are actually put to, as well as the incredible number of key users and owners which provide a relatively large potential market to whom one hopes to attract. In an effort to provide the U.S. Patent and Trademark Office Examiner with prior patent art known to the inventor and his patent attorney, the following brief description of patents uncovered during a preliminary patent search are set forth and identified for the convenience of the Examiner.

U.S. Pat. No. 312,545 to Zeilen, as long ago as in 1885, recognized the need for a key having what is described within this patent as a detachable name-plate. Reference to FIGS. 1–5 of the drawings of this patent disclose the old-style key that preceded present-day mass production techniques, with which a detachable plate provides an indication of the name of the owner or the room to which the key belongs.

U.S. Pat. No. 868,948 to Strauss, as early as in 1907, discloses an improvement in a key wherein a name or number plate is attached to the key by solder or other fusible material, as best seen in FIGS. 1 and 3 of the drawings of this patent.

U.S. Pat. No. 1,032,930 to Moseley discloses a key carrying an identification number or mark carried by the key in a relatively concealed manner, whereby the numbers or marks are concealed within a recess and which can be changed without changing or disfiguring the exposed surface of the key.

U.S. Pat. No. 1,219,706 to Dahne discloses a means for identifying a key of the flat type such as is used in connection with cylinder locks, and whereby a plate is screwed tightly into the head of the key, this plate carrying the indicia "office", for example, as best seen in FIG. 1 of the drawings of this patent.

U.S. Pat. No. 1,322,815 to Patterson discloses identifying means for night latch keys, whereby a plurality of superposed cards or the like carrying names of successive owners or users of the key are alternately exposed or concealed so as to permit a name, number or other character on the newly exposed card.

U.S. Pat. No. 1,573,536 to Benham teaches a key which carries removable plates, which are held by means of a screw to the key at a position best seen in FIG. 2 of the drawings of this patent.

U.S. Pat. No. 1,653,581 to McKellar discloses a key which contemplates the loss of the key. In this patent, means are disclosed for identifying the name and address of the owner of the key, together with an offer of an award for the return so as to improve the chance of restoration to its owner. Nowadays, as opposed to in 1927 when this patent was granted, one would hardly want the identity and address of the owner of the key to be accessible to the finder, with the high incidence of crime and burglaries so commonly accepted today.

U.S. Pat. No. 1,629,343 to Katz discloses a key identification device wherein a removable disc is provided within a recess so as to provide means for a bank, for example, to change references to customers who own safety deposit boxes.

U.S. Pat. No. 1,794,498 discloses a key tag in the name of Ridgway, the tag being of the type attachable to the key ring to which the key is normally attached and carried, and providing a partial covering of the key on which the identity of the room or area with which the key is associated is visible.

U.S. Pat. No. 1,892,995 to Nicholson discloses a marking plate for keys and a method of securing same. The specific structure shown within this patent has applicability to safety deposit boxes in banks wherein the number of the box is associated with the key itself.

U.S. Pat. No. 2,349,749 to Morris discloses an identification device in the form of a key wherein an effort to avoid relatively sharp edges is accomplished by means of a structure best seen in FIGS. 1–4 of this patent.

U.S. Pat. No. 2,533,006 to Goldsmith was granted in 1950 and discloses a key identification holder wherein slots in the key accommodate an identifying plate.

U.S. Pat. No. 2,781,594 to Stupell discloses a decorative plate and mounting for a key, best seen in FIGS. 1 and 4 of the drawings. This particular patent contemplates providing the user with a monogram capable of being fixed to the article, such as a key, by relatively inexperienced people.

U.S. Pat. No. 2,988,836 discloses a key identifier in the name of Oberfield, in the form of a strip positioned diagonally across one side of the "handle" of the key, as best seen in FIGS. 1 and 2 of the drawings of this patent.

U.S. Pat. No. 3,093,920 to Epstein et al discloses a reinforced key wherein decorative indicia is affixed to an insert on a key head permanently, such as shown in FIGS. 4–5 of this patent.

Finally, U.S. Pat. No. 3,324,586 to Mitchell discloses a markable card or material inserted in a cut out portion of the top of a key, so as to provide the owner of a car, for example, with means for identifying the lock with which the key is associated.

While all of these patents are interesting in one way or another, insofar as the state of the prior art is concerned, none of these patents really teaches the specific structure of the present invention as will be described in more detail below. My invention will be more clearly understood from the following description of specific embodiments of the invention, together with the accompanying drawings, wherein similar character references denote similar elements throughout the several views and in which:

FIG. 1 is a front view of a key according to the present invention;

FIG. 2 is a partial fragmentary side sectional view of the key shown in FIG. 1, shown in enlarged configuration, so as to make more easy the identification of the specific elements of the present invention;

FIG. 3 is a partial fragmentary sectional view of the head or gripping portion of the key shown in FIG. 1, illustrating one preferred embodiment of the present invention wherein the strip bearing indicia is located beneath the surface of the key face and is covered by a strip of plastic material;

FIG. 4 is a view similar to FIG. 3, wherein the strip bearing the indicia is located beneath but flush with the surface of the head or gripping portion of the key;

FIG. 5 is a view similar to FIG. 3, wherein the strip bearing the indicia is located beneath the surface of the head or gripping portion of the key, but absent the clear or transparent strip of plastic; and FIG. 6 is a view similar to FIG. 3, wherein the strip bearing the indicia is carried on, as opposed to within, the surface of the head or gripping portion of the key, according to the present invention.

Referring now in more detail to the drawing, within FIG. 1 a key 10 according to the present invention is shown extending between what I shall characterize as a gripping end 12 and an entering end 14 opposite thereof. Key 10 is shown in FIG. 1 in the familiar form known to many users who use keys associated with cylinder locks of the common door type and, therefore, is shown in the typically elongated form with a carrying hole 16 through which a key chain or ring may be used, and with the usual and conventional notches 18 and grooves 20 which make the key compatible with its cooperative and respective cylinder lock. For convenience, the enlarged head or gripping portion 22 has been named such so as to be consistent with the description herein and the claims appended hereto.

Before proceeding further with this technical description of the present invention with respect to the drawings, it is important here for me to emphasize that while this invention is being described in terms of a specific embodiment, such as that shown in FIG. 2, any number of variations of the present invention is contemplated without departing from the spirit of my concept and invention. For example, the reader will see within FIG. 2 a pair of strips and a pair of magnifying members or means, whereas this invention contemplates only a single strip or a single strip without magnifying means. However, in order to give the reader an appreciation of the variety of elements and their structural combinations that may be provided with the present invention, liberty has been taken and will be taken in describing preferred or alternate embodiments.

In FIG. 2, a preferred embodiment of the present invention is shown in the form of a partial and fragmentary sectional view taken through FIG. 1 along the line 2—2 thereof. Head or gripping portion 22 is shown formed with a groove 24 recessed within side or face 26 thereof. By way of example only, side or face 28 opposite side or face 26 is shown within FIG. 2 as not having a groove, although the present invention contemplates either a pair or grooves or no grooves at all, for example.

An elongated strip 30 is shown in FIG. 2 as disposed within and secured to the bottommost portions of groove 24. Strip 30 is of a material that will accept indicia applied by the user by ball point pen, for example, ink, or other suitable means. As best seen in FIG. 1, should the key 10 of the user be associated with the front door of his or her home, for example, the user may simply affix the words "front door" to strip 30 such that it will be visible as best seen in FIG. 1 of the drawing.

A magnifying member 32, preferably of plastic transparent and optically sound material is shown with portions thereof disposed in contact with strip 30 and within the recesses of groove 24 of key 10. Magnifying member 32 not only serves to protect strip 30 from further marking or damage, but even more importantly, to magnify for the user's benefit the very indicia carried by strip 30 so as to enable the user to more rapidly and efficiently utilize this reference material when viewing the side 26 of key 10. It is also contemplated by the present invention to provide the outer surface of strip 30 with a coating of phosphorescent or otherwise glowing material 34 such that the indicia carried by strip 30 may be seen through the magnifying member 32 in dimly lit environments or in those wherein it is completely dark and the user wishes to identify his or her key without the trial and error method. It should also be noted here that this phosphorescent or otherwise glowing coating on strip 30, given reference character 34, is not absolutely essential for the present invention to operate according to its intended purposes.

Also shown in FIG. 2 is a second strip 36 of material corresponding to that already described for strip 30. In the case of strip 36, this strip simply lies on the surface 28 of gripping or head portion 22 of key 10 such that it provides the user with the ability to simply add this strip to keys that are already in the marketplace in "after market" applications. Similarly, a magnifying member 38 is provided within the embodiment shown in FIG. 2, as are a plurality of relatively small projections 40 affixed to the outer surfaces of magnifying member 38.

As has already been described for strip 30 and magnifying member 32, strip 36 is capable of carrying indicia applied by the user and magnified by means of member 38. In addition, projections 40 may be applied by the user in any number and in any number of combinations corresponding to the user's referencing of these placements of projections 40 with respect to the identification of the key and/or lock with which the key is associated. In other words, in the case of the front door of the user's home, the user may place two projections 40 in the configuration shown in FIG. 2 such that by lightly touching magnifying member 38 and the outer surfaces thereof, the recognition of two projections will in the mind of the user reference the key carrying these projections with the front door just mentioned.

Thus, as can now be seen from FIGS. 1 and 2 and the foregoing description of these figures, the user of key 10, according to the present invention, is provided with a number of different indicating and reference identifying means with which to identify key 10 with the owner, the lock with which the key is associated, the room with which the key and the lock are associated, and any other reference indicia that the user may feel important or desirable to him or to her. Also, key 10 provides the user with both visual and touching means for identifying key 10 in the dark or in the light, and in the case of darkness the key is identifiable both by the glowing aspect of the contrast between the indicia and the glowing background provided by material 34 on strip 30, as well as the presence of one or more projections 40 on the opposite side of the key. Thus, the user may simply by fingering or touching the key within his or her pocket or purse, identify the key before taking the key out of the pocket or purse, such as might be the case in an unsafe neighborhood or environment, or for that matter, the user once he or she has reached the lock with which the key is associated, may rapidly and efficiently utilize the information provided by these various indicating means to quickly select the proper key and utilize same.

Other embodiments and forms of this invention are also contemplated, such as those shown in FIGS. 3–6 of this specification and drawing. In the case of FIG. 3, key 10 is shown with strip 30 located within groove 24, but absent the magnifying member 32. In its place, a transparent plastic protective cover sheet 42 is in contact with and overlies strip 30 within groove 24 such that the cover sheet 42 is substantially flush with face or side 26 of head portion 22 of key 10.

FIG. 4 illustrates an embodiment of the present invention wherein strip 30 is situated within a relatively shallow groove 24, without a plastic cover sheet, such that the strip 30 lies substantially flush with surface 26 of head portion 22 of key 10.

FIG. 5 illustrates an embodiment of the present invention wherein strip 30 is located or disposed within groove 24, as described for the embodiment of the present invention illustrates in FIG. 3, but absent the cover sheet 42.

FIG. 6 illustrates an embodiment of the present invention wherein strip 30 is simply disposed on the surface of face 26 of head or gripping portion 22 of key 10 in a manner which obviates the need for a groove.

The present invention contemplates strips 30 and 36, or either of them, being permanently bonded to the key or removable from the key at the option of the user. These strips may be made of any material, such as plastic or the like, which will retain writing or indicia in a manner known to owner to credit cards with signature panels thereon. The specific dimensions and shapes of the strips, the magnifying members and the grooves may be altered without departing from the scope and spirit of this invention.

The embodiments of the present invention particularly disclosed herein are presented merely as examples of the invention. Other embodiments, forms and modifications of the invention coming within the proper scope of the appended claims will, of course, readily suggest themselves to those skilled in the art.

What is claimed is:

1. A key, comprising, in combination: an elongated body portion extending between gripping and entering ends thereof, said elongated body portion including opposite substantially planar surfaces formed with predetermined recesses therewithin, said gripping end comprising a relatively enlarged portion normally gripped by the thumb and at least one other of the user's fingers during operation of the key within a cylinder lock, at least one of the opposite surfaces of said relatively enlarged portion being formed with a groove of a predetermined depth beneath said surface; a strip of material disposed within said groove against the bottommost portions thereof, said strip capable of bearing first indicia of the user's choice placed thereon by the user; a substantially transparent magnifying member having portions thereof normally in contact with and overlying said strip for magnifying the indicia added to said strip for reference thereto thereafter, said groove being disposed within a first of said opposite sides, a second of said opposite sides carrying a second strip of material capable of bearing second indicia of the user's choice placed thereon by the user, a second substantially transparent magnifying member having portions thereof normally in contact with and overlying said second strip for magnifying the indicia added to said strip for reference thereto thereafter by the user, one of said first and second magnifying members carries a plurality of relatively small projections capable of being contacted by a finger of the user, thereby facilitating identifying the key and its associated lock without viewing same.

2. A key, according to claim 1, wherein said strip and the indicia thereon is visible in the dark.

3. A key, according to claim 1, wherein said strip lies flush with said opposite side defining said groove.

4. A key, according to claim 1, wherein said strip lies beneath the surface of said opposite side defining said groove.

5. A key, according to claim 1, wherein said strip lies above the surface of said opposite side defining said groove.

6. A key, according to claim 1, wherein means are provided for changing the indicia on said strip.

* * * * *